US010441051B2

(12) United States Patent
Brinkert et al.

(10) Patent No.: US 10,441,051 B2
(45) Date of Patent: Oct. 15, 2019

(54) CLEANING FLUID FOR ELECTRICAL PERSONAL CARE APPARATUS

(75) Inventors: Jacob Brinkert, Drachten (NL); Tatiana Dimitrova, Drachten (NL); Philippe Leonard Joseph Verheyden, Brussels (BE); Andre Jozef Maria Nagels, Mechelen (BE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 1095 days.

(21) Appl. No.: 11/911,149

(22) PCT Filed: Apr. 11, 2006

(86) PCT No.: PCT/IB2006/051104

§ 371 (c)(1),
(2), (4) Date: Oct. 10, 2007

(87) PCT Pub. No.: WO2006/109242

PCT Pub. Date: Oct. 19, 2006

(65) Prior Publication Data

US 2008/0092930 A1 Apr. 24, 2008

(30) Foreign Application Priority Data

Apr. 14, 2005 (EP) ..... 05102974

(51) Int. Cl.

| | |
|---|---|
| ***A45D 27/46*** | (2006.01) |
| ***C11D 1/65*** | (2006.01) |
| ***C11D 1/83*** | (2006.01) |
| ***C11D 1/86*** | (2006.01) |
| ***B26B 19/38*** | (2006.01) |
| ***C11D 1/22*** | (2006.01) |
| ***C11D 1/58*** | (2006.01) |
| ***C11D 1/72*** | (2006.01) |
| ***B08B 3/04*** | (2006.01) |
| ***C11D 3/34*** | (2006.01) |
| *C11D 11/00* | (2006.01) |

(52) U.S. Cl.
CPC ..... *A45D 27/46* (2013.01); *C11D 3/3418* (2013.01)

(58) Field of Classification Search
USPC ..... 134/201; 510/119, 127
See application file for complete search history.

(56) References Cited

U.S. PATENT DOCUMENTS

| | | | | |
|---|---|---|---|---|
| 5,147,575 | A | 9/1992 | Hampton | |
| 5,470,508 | A * | 11/1995 | Narayanan et al. | 510/365 |
| 5,494,488 | A * | 2/1996 | Arnoldi et al. | 510/292 |
| 5,641,742 | A * | 6/1997 | Adamy et al. | 510/500 |
| 5,731,282 | A * | 3/1998 | Duquesne | 510/423 |
| 5,849,105 | A * | 12/1998 | Massaux et al. | 134/29 |
| 6,239,089 | B1 | 5/2001 | Cala | |
| 2002/0049149 | A1* | 4/2002 | Durbut et al. | 510/413 |
| 2002/0069902 | A1 | 6/2002 | Hoser | |
| 2002/0155969 | A1* | 10/2002 | Rees et al. | 510/384 |
| 2002/0187918 | A1* | 12/2002 | Urban | 510/505 |
| 2004/0067866 | A1* | 4/2004 | Griese et al. | 510/407 |
| 2005/0189003 | A1* | 9/2005 | Saito et al. | 134/10 |
| 2005/0277562 | A1* | 12/2005 | Xia et al. | 510/161 |
| 2006/0111265 | A1* | 5/2006 | Rypkema et al. | 510/504 |

FOREIGN PATENT DOCUMENTS

| | | |
|---|---|---|
| DE | 10221335 | 11/2003 |
| JP | H0468097 | 3/1992 |
| JP | 07171210 | 7/1995 |
| JP | H10279999 | 10/1998 |
| JP | 11092795 | 4/1999 |
| JP | 2000093668 | 4/2000 |
| JP | 2000143470 | 5/2000 |
| JP | 2000273497 | 10/2000 |
| JP | 2002309298 | 10/2002 |
| WO | 03004594 | 1/2003 |

OTHER PUBLICATIONS

Login, "Pyrrolidone-Based Surfactants (a Literature Review)", Journal of the American Oil Chemists' Society 72(7):759-771—Jul. 1995.

Rosen, et al: "Predicting synergism in binary mixtures of surfactants", Surfactants and Colloids in the Environment Progress in Colloid and Polymer Sci, vol. 95, pp. 39-45, 1994.

The Dow Chemical Company, "DOW Surfactants: A Guide to Products and Performance for Household and Institutional & Industrial Cleaners" http://msdssearch.dow.com/PublishedLiteratureDOWCOM/dh_096d/0901b8038096ddf2.pdf?filepath=surfactants/pdfs/noreg/119-01544.pdf&fromPage=GetDoc.

* cited by examiner

*Primary Examiner* — Mikhail Kornakov
*Assistant Examiner* — Natasha N Campbell

(57) ABSTRACT

A fluid aqueous composition for cleaning an electric personal care apparatus including at least one alkyl benzene sulfonate and at least two non-ionic surfactants. The alkyl benzene sulfonate may be sodium alkyl benzene sulfonate. The non-ionic surfactants may be a fatty alcohol polyalkylene glycol ether and a fatty alcohol polyglycol ether.

18 Claims, No Drawings

CLEANING FLUID FOR ELECTRICAL PERSONAL CARE APPARATUS

The invention relates to a composition for cleaning an electric personal care apparatus, in particular an electric shaver, and to a method for cleaning such apparatus.

DE-A 102 21 335 relates to a fluid cleaning solution for electric shavers comprising an alcohol as a solvent and a non-ionic surfactant. Drawbacks of solutions with an alcohol as a solvent include the flammability of the solution, the health risks related to alcohol, incompatibility with some materials used for the shaver and a fast evaporation of the solvent.

It is an object of the present invention to provide a novel cleaning composition for cleaning electric personal care apparatuses.

It is in particular an object of the invention to provide a novel cleaning composition that overcomes one or more of the drawbacks of alcohol based cleaning solutions for cleaning electric personal care apparatuses, such as electric shavers.

In an aspect, the invention aims to provide a novel cleaning composition which has a favorable effect on the behavior of hairs, whiskers and other debris, removed from the apparatus, in the cleaning solution, such as a good sedimentation of the debris to the bottom of the container in which the fluid may be held during use and/or a low tendency of adherence of the debris to the wall(s) of such container.

It has now been found that one or more of these objects are achieved by a composition based on a different solvent and comprising a specific combination of surfactants.

Accordingly, the present invention relates to a fluid aqueous composition for cleaning an electric personal care apparatus, in particular an apparatus for removing hair and/or whiskers, the composition comprising at least one alkyl benzene sulfonate; and at least one non-ionic surfactant.

In an embodiment, a composition according to the invention may be used directly, i.e. without requiring dilution by the end-user. This is advantageous with respect to the ease of use, but it has also been found that thereby the risk of scaling problems, which may be the result of dilution with tap water, can be avoided or at least be reduced.

A composition according to the invention is generally inflammable, safe to handle, and safe to the skin.

A composition according to the invention has a low tendency to evaporate during use.

It has been found that a fluid composition according to the invention is effective in removing debris—in particular hairs, whiskers and/or debris originating from skin—from an electric personal care apparatus. The composition has been found particularly suitable for cleaning an apparatus for removing hair from the skin. Suitable apparatuses include electric shavers such as clippers (trimmers, shears), depilators and razors. Suitable methods to clean the apparatus with the fluid composition may be based on a method known in the art, e.g. as described in the instructions guide for the particular apparatus.

Accordingly, the invention also relates to the use of an aqueous fluid composition comprising at least one linear alkyl benzene sulfonate and at least one non-ionic surfactant for cleaning an electric personal care apparatus, in particular an electric shaver.

In particular, the invention further relates to a method of cleaning an electric apparatus for removing hair (including whiskers), comprising contacting the hair removing part of the apparatus with a fluid composition as defined above;

optionally operating the hair removing part of the apparatus; and allowing debris from the hair removing part of the apparatus to release from the removing part;

ending the contacting of the hair removing part of the apparatus and the fluid composition.

The contacting may in particular be carried out by submerging the hair removing part (such as the cutting blades of a shaver) in the fluid composition. For very good results, the hair removing part is usually placed up side down, i.e. placed such that it allows the debris to fall out of the apparatus. Suitable systems in which the apparatus can be placed are known in the art, and may be delivered with the apparatus.

In particular, it has been found that a composition comprising at least anionic surfactant and/or at least one non-ionic surfactant, such as a composition according to the invention, not only cleans adequately but also contributes to improved sedimentation of debris (such as hairs) when the part of the apparatus that is to be cleaned is submerged in the cleaning composition.

Accordingly, the invention further relates to the use of an anionic surfactant—in particular an alkyl benzene sulfonate—and/or a non-ionic surfactant—in particular a non-ionic surfactant mentioned herein—in a cleaning fluid (for cleaning an apparatus for removing hair from skin), as a sedimentation aid, that is to improve sedimentation of hairs in the fluid.

Further, it has been found that in accordance with the invention the cleaning composition may contribute to reducing or even avoiding deposition of the hairs to the wall(s) of the container wherein the fluid composition may be held during the cleaning.

Accordingly, another aspect of the invention is the use of an anionic surfactant—in particular an alkyl benzene sulfonate—and/or a non-ionic surfactant—in particular a non-ionic surfactant mentioned herein—in a cleaning fluid (for cleaning an apparatus for removing hair from skin), to reduce or avoid adherence of the hair to the walls of a container holding the fluid and hairs.

Unless specified otherwise, the weight percentages used herein are based on the total weight of the fluid composition.

The term "aqueous" is used herein to indicate that the composition predominantly consists of water, i.e. comprising at least 50 wt. % of water. Usually, the water content is at least 70 wt. % (based on the total weight), preferably at least 80 wt. %, more preferably at least 90 wt. %.

Usually, the water content does not exceed 99.9 wt. %. Preferably the water content is up to 99 wt. %, more preferably up to 98 wt. %.

Preferably, the composition is essentially free of ethanol, more preferably of all C1-C3 alcohols, even more preferably the composition is essentially free of easily flammable organic solvents, such as ethanol and other solvents having the same or a higher flammability at room temperature (about 20° C.). A composition is in particular considered essentially free of a solvent in case the concentration thereof does not exceed 1 wt. %, more in particular if the concentration thereof is 0-0.5 wt. %, even more in particular if the concentration is 0-0.1 wt. %.

As indicated above, the composition comprises at least one alkyl benzene sulfonate. In principle any alkyl benzene sulfonate surfactant or mixture thereof may be present. In particular suitable is an alkyl benzene sulfonate, wherein the alkyl contains 10-60 carbon atoms, preferably 10-18 carbon atoms, more preferably 10-14 carbon atoms. The alkyl may be linear or branched. Particularly good results have been achieved with a mixture comprising $C_{10}$-$C_{14}$ alkyl benzene sulfonates. Usually the alkyl benzene sulfonate is a sodium salt of the sulfonate.

The alkyl benzene sulfonate, besides having a cleaning effect, has been found particularly useful to impart good sedimentation behavior of debris, such as hair. Further, it has been found that such compound may contribute to reducing the tendency of debris to the wall(s) of a container wherein the fluid composition may be held during cleaning. The alkyl benzene sulfonate may also contribute to an improved solubilization of one or more additives, such as fragrances.

The concentration of the alkyl benzene sulfonate(s) is usually at least 0.08 wt. %, preferably at least 0.4 wt. %, more preferably at least 0.5 wt. %, in particular at least 0.75 wt. %.

In particular, for a composition that is ready to use (i.e. without needing dilution by the end-user) the concentration of the alkyl benzene sulfonate(s) is preferably 3 wt. % or less, more preferably 2 wt. % or less, even more preferably up to 1 wt. %. Thus, it has been found possible to provide a composition with good cleaning properties, and usually favorable behavior with respect to the sedimentation of debris, whilst the foaming properties are desirably low.

Preferably one or more non-ionic surfactants are selected from the group consisting of:

fatty alcohol-N-poly(alkylene)glycol ethers, wherein N represents the number of glycol ether moieties, N preferably being from 3-10, more preferably 5; and alkylpyrrolidones, preferably 1-($C_6$-$C_{18}$)-2-pyrrolidones, more preferably 1-(octyl)-2-pyrrolidone In case of the alcohol-N-poly(alkylene)glycol ethers, the alcohol is preferably a $C_6$-$C_{12}$ monohydric (iso)alcohol, more preferably (iso)decanol.

The concentration of the non-ionic surfactant(s) is usually at least 0.002 wt. %, preferably at least 0.01 wt. %. Usually the concentration is up to 3 wt. %, in particular 2 wt. % or less. In particular for maintaining a low tendency to foaming, the concentration of non-ionic surfactant(s) preferably is up to 1 wt. %.

In particular in a ready to use composition according to the invention, the concentration of non-ionic surfactant(s) is preferably in the range of 0.002 wt. % to 0.2 wt. %, more preferably in the range of 0.01 to 0.15 wt. %.

With respect to the alcohol-N-poly(alkylene)glycol ether, a concentration of 0.000085 to 0.05 wt. % is considered highly suitable, especially in a ready to use composition, in particular in combination with at least one other non-ionic surfactant such as an alkylpyrrolidone. Regarding the alkylpyrrolidone, a concentration of 0.01-0.1 wt. % has been found particularly effective, especially in a ready to use composition, in particular in combination with the alcohol-N-poly(alkylene)glycol ether.

In an embodiment, the fluid composition comprises at least one alkyl benzene sulfonate and at least two non-ionic surfactants. In such case, at least one of the non-ionic surfactants is preferably an alcohol-N-polyglycol ether, in particular such an ether as defined above. In such an embodiment, at least one other non-ionic surfactant is preferably an alkylpyrrolidone, more preferably 1-($C_6$-$C_{18}$)-2-pyrrolidones, even more preferably 1-(octyl)-2-pyrrolidone.

In a ready to use composition comprising at least two non-ionic surfactants, particularly good results have been achieved with a composition as indicated in the following table:

TABLE 1

| Ingredient | preferred concentration range | more preferred concentration range |
|---|---|---|
| alkylbenzenesulfonate | at least 0.08 wt. % | 0.4-1 wt. % |
| alkylpyrrolidone (such as 1-($C_6$-$C_{18}$alkyl)-2 pyrrolidone, in particular 1-(octyl)-2 pyrrolidone) | at least 0.002 wt. % | 0.01-0.1 wt. % |
| alcohol polyglycol ether (such as isodecylalcohol-N-polyglycolether, wherein N is from 3-10, in particular 5) | at least 0.00005 wt. % | 0.000085-0.05 wt. % |

In addition to water, alkyl benzene sulfonate and non-ionic surfactant, one or more additives may be present. Such additives include cosmetically acceptable additives selected from the group consisting of lubricants (such as glycerol), fragrances, fat removing agents, antioxidants, colorants, UV-protecting agents, pH-regulating agents (in particular pH-buffering agents) and preservatives. Suitable examples thereof are known in the art.

Preferably a non-oily lubricant is present. The lubricant should preferably dissolve (or be emulsified) in the fluid composition at the intended concentration. Suitable lubricants include glycerol, polyethyleneglycol and the like. In particular preferred is glycerol. Glycerol has been found particularly effective for lubricating the hair removing part of the apparatus (such as the cutting blades), without leaving a residue, in particular without leaving an oily residue.

If present, the concentration of the lubricant is preferably at least 0.01 wt. %, more preferably at least 0.1 wt. %. The concentration preferably is 10 wt. % or less, in particular 5 wt. % or less. A concentration within these ranges is in particular considered advantageous with respect to avoiding leaving of residues, whilst providing favorable lubrication.

Suitable fat removing agents include alkoxyalkylalkoxy-alcohols, such as (2-methoxymethylethoxy) propanol. If present, the concentration may be at least 0.05 wt. %. A concentration of up to 1 wt. % usually suffices.

If present, the concentration of fragrance(s) (e.g. citron) may be in the range of 0.01-1 wt. % in particular in the range of 0.05-0.8 wt. %.

If present, the concentration of preservative(s) (e.g. Kathon CG, O-phenyl phenol, 2-bromo-nitropropane-1,3 diol, benzyl alcohol, 3-iodo-2-propinyl butyl carbamate, phenoxy ethanol, dehydro acetic acid, benzoic acid, lactic acid, sorbic acid) is usually at least 0.01 wt. %, in particular in the range of 0.01-5 wt. %, more in particular in the range of 0.07-1.1 wt. %.

The presence of a pH regulating agent, in particular a buffer, may help to stabilize the composition, in particular the preservative, if present. Suitable buffers and concentrations depend on the intended pH, which may for instance be an essentially neutral pH (a pH up to 1 pH unit above or below the neutral pH value). The skilled person will know how to prepare a composition with an effective amount of buffer.

A composition according to the invention is preferably made from demineralized water (e.g. distilled or deionized water) and preferably contains relatively low levels of inorganic ions (other than counter ions of the alkyl benzene sulfonate(s) and optionally additives), such as calcium, magnesium, chloride and other inorganic anions compared to a composition that is prepared with tap water (e.g. a concentrate to diluted by the end-user or a ready to use composition industrially prepared with tap water). It has been found that thereby the risk of scaling can be reduced.

Accordingly, the present invention further relates to a method of preparing a fluid aqueous composition for cleaning an electric personal care apparatus, in particular an apparatus for removing hair, the composition comprising at least one alkyl benzene sulfonate; and at least one non-ionic surfactant, said method comprising mixing demineralized water with the alkyl benzene sulfonate(s), the non-ionic surfactant(s), and—if present—the additive(s).

The invention will now be illustrated by the following examples.

EXAMPLE 1

Several compositions where made, comprising one or more of the following ingredients:

TABLE 2

| Component # | name | concentration of the active ingredient (wt. %) |
|---|---|---|
| D | Dowanol DPM (fat removing agent) | 0.25 |
| H | Heloxyl AL80 80 wt. % active ingredient: sodium alkyl benzene sulfonate) | 0.4 |
| P | Propetal 99 fatty alcohol polyalkylene glycol ether (non-ionic surfactant) | 0.5 |
| Z | Zusolat 1005/85 85 wt. % active ingredient fatty alcohol polyglycol ether (non-ionic surfactant) | 0.02 |
| S | Surfadone LP100 (1-octyl-2-pyrrolidone) (non-ionic surfactant) | 0.05 |
| G | glycerol (lubricant) | 5 |
| C | citron (fragrance) | 0.1 |
| | Kathon CG (preservative) | 0.07 |
| | Brilliant blue (colorant) | <0.01 |
| | water (demineralised) | balance |

The following tests were performed:

1) The fluids were visually evaluated for clarity (transparency) A "+" means that the fluid is transparent to the naked eye (after adding hairs).

2) To 100 ml of the fluid 0.1 g of hairs were added. The fluids were visually tested for "hair sink" (debris sedimentation) performance for at least 6 min. A "+" indicates that the hair sink properties are good.

3) After completing the hair sink test, the beaker was gently shaken and the (eventual) deposition of hairs on the walls was scored. A "+" indicates that essentially no hair is deposited on the walls.

TABLE 3

| components present | hairs sink | wall deposition | clarity |
|---|---|---|---|
| DHPZS GC | + | + | + |
| DHPZS | + | + | + |
| DHPZ GC | + | + | + |
| DHPZ | + | + | + |
| HPZS GC | + | − | + |
| HPZS | + | − | + |

TABLE 3-continued

| components present | hairs sink | wall deposition | clarity |
|---|---|---|---|
| HPS GC | + | − | + |
| HPS | + | − | + |
| HZS GC | + | + | + |
| HZS | + | + | + |
| HS GC | + | + | + |
| HS | + | + | + |
| DPZS GC | − | − | − |
| DPZS | − | − | + |
| DPS GC | − | − | − |
| DPS | − | − | − |

From the above results it was concluded that the alkyl benzene sulfonate (H) is in particular of importance for obtaining favorable hairs sink.

Of the non-ionic surfactants fatty alcohol polyglycol ether (Z) and the alkyl pyrolidone (S) are considered particularly advantageous.

EXAMPLE 2

Fluid compositions where made, comprising the linear alkyl benzene (H), and two non-ionic surfactants (Z and S) in varying concentrations as indicated below.

The fluids were tested as follows:

1) Visual (V): it was checked whether the fluid is turbid (+) or clear (−) before (V1) and after (V2) adding 0.5 g hairs to 100 ml of fluid in a beaker. Note that the 0.5 g of hairs corresponds to about a monthly "load" of the fluid with hairs, in case an electric razor is cleaned with the fluid 2) Hairs sink (B): for all fluids it was checked whether any hairs were present (−) or not (+) on the surface of the fluid, about 2 hours after adding the hairs.

3) Deposit on walls of beaker (W): the beakers from point 1 were gently shaken and the eventual deposition of hairs on the walls was scored. Here "+" means that essentially no hairs were deposited on the walls, whereas "−" indicated that many hairs were left on the walls of the beaker.

In all tests "nd" is used to indicate that it was not readily determinable whether the result of the test should be marked "+" or "−".

TABLE 4

| H (wt. %) | Z (wt. %) | S (wt. %) | V1 (wt. %) | V2 | B | W |
|---|---|---|---|---|---|---|
| 0.008 | 0.0425 | 0.1 | + | + | + | nd |
| 0.08 | 0.0085 | 0.002 | + | nd | + | − |
| 0.08 | 0.0085 | 0.002 | + | − | + | − |
| 0.08 | 0.0425 | 0.1 | nd | − | + | nd |
| 0.4 | 0.00085 | 0.01 | + | − | nd | + |
| 0.4 | 0.0425 | 0.1 | + | − | + | + |
| 0.4 | 0.0085 | 0.002 | + | − | nd | + |
| 0.4 | 0.0085 | 0.01 | + | − | nd | + |
| 0.4 | 0.0085 | 0.1 | + | − | + | + |
| 0.8 | 0.0085 | 0.002 | + | − | + | + |
| 0.8 | 0.0085 | 0.01 | + | − | + | + |
| 0.8 | 0.0085 | 0.1 | + | − | + | + |
| 0.8 | 0.0 | 0.1 | + | nd | + | − |

weight percentages are for the active ingredient, i.e. the surfactants

The above results show that, besides the compositions being effective cleaning compositions, compositions in accordance with the invention show to be favorable in view of at least one of the properties "hair sink" and "deposition to the wall", within a wide range of concentrations.

With respect to the visual appearance, it is observed that the invention allows formulation of transparent compositions, if desired. The composition may turn turbid after adding the hair. The different appearance prior to use and thereafter may be well appreciated by end users.

The invention claimed is:

1. A system for cleaning debris from a portion of an electric personal care apparatus, the system comprising:

a container for submerging the portion of the electric personal care apparatus; and a fluid aqueous composition provided in the container for providing sedimentation of the debris from the submerged portion to the bottom of the container, the fluid aqueous composition comprising:

from at least 0.08 wt. % up to 3 wt. % of at least one alkyl benzene sulfonate for enabling sinking of the debris and comprising sodium alkyl benzene sulfonate;

from at least 0.002 wt. % up to 3 wt. % of non-ionic surfactants including at least two non-ionic surfactants including at an alkylpyrrolidone and an alcohol-N-polyglycol ether, wherein N represents a number of glycol ether moieties and the alcohol is a monohydric alcohol; and polyethyleneglycol.

2. The system according to claim 1, wherein the fluid aqueous composition further comprises organic solvents selected from ethanol and $C_1$-$C_3$ alcohols.

3. The system according to claim 1, wherein the alkyl benzene sulfonate contains 10 to 14 carbon atoms.

4. The system according to claim 1, wherein the number of glycol ether moieties N is from 3-10 and alkylpyrrolidone is 1-($C_6$-$C_{18}$)-2-pyrrolidone.

5. The system according to claim 4, wherein the alcohol moiety of the polyglycol ether is an (iso)decanol moiety.

6. The system according to claim 1, wherein one of the non-ionic surfactants is 1-($C_6$-$C_{18}$)-2-pyrrolidone and another one of the non-ionic surfactants is isoalcohol-N-polyglycol ether where N is 5.

7. The system according to claim 1, wherein a concentration of alkyl benzene sulfonate(s) is at least 0.75 wt. %.

8. The system according to claim 1, wherein a concentration of the non-ionic surfactant(s) is in the range of 0.01 wt. % to 0.2 wt. %.

9. The system according to claim 1, wherein the composition further comprises demineralized water, and the water content of the fluid composition is in the range of 90-99 wt. %.

10. The system according to claim 1, wherein a total concentration of the non-ionic surfactants is in a range of 0.01 wt. % and 1 wt. %.

11. The system according to claim 1, wherein the fluid composition is a ready to use composition and a total concentration of the non-ionic surfactants is in the range of 0.01 to 0.15 wt. %.

12. The system according to claim 1, wherein one of the non-ionic surfactants comprises 1-octyl-2-pyrrolidone.

13. The system according to claim 12, wherein the alkyl benzene sulfonate is in the range of 0.4 to 1.0 wt. %, the 1-octyl-2-pyrrolidone is in the range of 0.01 to 0.09 wt. %, and wherein one of the non-ionic surfactants comprises fatty alcohol polyalkylene glycol ether in the range of 0.000085 to 0.05 wt. %.

14. The system according to claim 1, wherein one of the non-ionic surfactants is selected from 1-octyl-2-pyrrolidone, glycerol and citron.

15. A method for cleaning an electric apparatus for removing hair debris, the method comprising acts of:

providing a container for submerging a hair removing part of the electric personal care apparatus;

providing a fluid composition in the container for providing sedimentation of the debris from the submerged portion to the bottom of the container, the fluid composition comprising:

up to 98 wt. % of water, from at least 0.08 wt. % up to 3 wt. % of at least one alkyl benzene sulfonate for enabling sinking of the hair debris, from at least 0.002 wt. % up to 3 wt. % of non-ionic surfactants including at least two non-ionic surfactants including at least an alkylpyrrolidone and an alcohol-N-polyglycol ether, wherein N represents a number of glycol ether moieties and the alcohol is a monohydric alcohol, and polyethyleneglycol;

allowing hair debris from the hair removing part of the apparatus to release from the removing part; and contacting the hair removing part of the electric apparatus in the container having the fluid composition.

16. The method according to claim 15, wherein the contacting involves immersing the hair removing part in the fluid composition.

17. A method for cleaning an electric personal care apparatus for removing hair debris, the method comprising acts of:

providing a container for submerging a hair removing part of the electric personal care apparatus;

adding a fluid composition in the container for providing sedimentation of the debris from the submerged portion to the bottom of the container, the fluid composition comprising:

up to 98 wt. % of demineralized water, from at least 0.08 wt. % up to 3 wt. % of at least one alkyl benzene sulfonate for enabling sinking of debris and comprising sodium alkyl benzene sulfonate, from at least 0.002 wt. % up to 3 wt. % of non-ionic surfactants including at least two non-ionic surfactant(s) including at least an alkylpyrrolidone and an alcohol-N-polyglycol ether, wherein N represents a number of glycol ether moieties and the alcohol is a monohydric alcohol, and polyethyleneglycol;

allowing hair debris from the hair removing part of the apparatus to release from the removing part; and contacting the hair removing part of the electric apparatus in the container having the fluid composition.

18. A system for cleaning debris from a portion of an electric personal care apparatus, the system comprising:

a container for submerging the portion of the electric personal care apparatus; and a fluid aqueous composition provided in the container for providing sedimentation of the debris from the submerged portion to the bottom of the container, the composition is essentially free of organic solvents flammable at about 20° C. and comprising:

up to 98 wt. % of water;

from at least 0.08 wt. % up to 3 wt. % of at least one alkyl benzene sulfonate for enabling sinking of the debris and comprising sodium alkyl benzene sulfonate;

from at least 0.002 wt. % up to 3 wt. % of non-ionic surfactants including an alkylpyrrolidone and a monohydric alcohol ether and 1-(octyl)-2 pyrrolidone; and polyethyleneglycol.

* * * * *